US005410850A

United States Patent [19]

Dreizler

[11] Patent Number: 5,410,850

[45] Date of Patent: May 2, 1995

[54] SPACER FOR REINFORCEMENTS

[76] Inventor: Siegfried Dreizler, Im Hegnach 5, D-7333 Ebersbach, Germany

[21] Appl. No.: 900,126

[22] Filed: Jun. 18, 1992

[30] Foreign Application Priority Data

Jun. 19, 1991 [DE] Germany ..... 41 20 215.5

[51] Int. Cl.[6] ..... E04C 5/16

[52] U.S. Cl. ..... 52/309.17; 52/677; 428/150

[58] Field of Search ..... 52/677, 309.17; 428/150

[56] References Cited

U.S. PATENT DOCUMENTS 4,518,641 5/1985 Shimmin et al. ..... 428/150
4,741,143 5/1988 Foster, Jr. ..... 52/677

FOREIGN PATENT DOCUMENTS 0356905 4/1990 European Pat. Off. ..... 52/677
2303133 10/1976 France ..... 52/677
3710971 10/1988 Germany ..... 428/150
4036919 5/1991 Germany .
2214076 8/1989 United Kingdom ..... 52/677

*Primary Examiner*—Carl D. Friedman
*Assistant Examiner*—Christopher Todd Kent
*Attorney, Agent, or Firm*—Harness, Dickey & Pierce

[57] ABSTRACT

A spacer for reinforcements has a body made of polymer concrete, with the polymer concrete consisting of a cured plastic material into which aggregates in the form of grains are integrated. The surface is post-treated in such a way that grains project from the surface of said cured plastic material, making possible an intimate chemical and physical bound with a cement paste of a concrete mass in which the spacer is to be embedded.

10 Claims, 3 Drawing Sheets

SPACER FOR REINFORCEMENTS

The invention relates to a process for producing a spacer for reinforcements, with a body made of polymer concrete, in which first a body is molded from a curable plastic compound with aggregates in the form of grains, and then the plastic compound is cured, with the grains being integrated into the resulting plastic matrix so as to result in a body with a smooth surface consisting of cured plastic material.

The invention further concerns a spacer for reinforcements with a body made of polymer concrete, with the polymer concrete consisting of a cured plastic material into which aggregates in the form of grains are integrated.

A process of this kind, and a spacer of this type, are known from DE-U-87 04 698.

In the production of concrete structural elements that are provided with a reinforcement, it is necessary to arrange the reinforcement at a certain distance from the inside of a form into which the still-liquid concrete will then be poured. The spacers not only ensure accurate positioning of the reinforcement within the form and consequently in the finished concrete structural element, but also guarantee that each reinforcement is at a certain minimum distance from the exterior of the concrete structural element being produced, i.e. that the reinforcement is covered with a specific thickness of concrete. This "required covering" must be at least 2 cm for construction work. The spacer is thus integrated into the cured concrete of the structural element.

The interfacial transition region between the exterior of the spacer and the cured concrete surrounding it represents a region subject to corrosion. Since the edge of a spacer facing the form rests directly on the form, but is otherwise surrounded by the cured concrete, a transition zone perceptible from the exterior of the structural element, which is particularly exposed to environmental influences, is present between the spacer and the cured concrete in contact therewith.

The interfacial transition region thus represents a critical region, since the two contiguous solid phases—i.e. the spacer on the one hand and the cured concrete on the other hand—have different mechanical and chemical properties, for example different coefficients of expansion. Because of the fluctuations in temperature to which a structural element is exposed, capillary or hairline cracks gradually appear between the surface of the spacer and the concrete surrounding it. Although attempts have already been made to manufacture spacers from the same concrete material as the concrete material that will subsequently surround the spacer, it was found that because of the different processing methods, capillary cracks nevertheless occur between the interfacial transition regions. The spacer is prefabricated, i.e. is made, for example, from a previously cured concrete material, so that even in the case where the concrete mass being poured in is identical in composition to the concrete from which the spacer was made, heterogeneous (i.e. different) bodies are present as the structural element cures. In particular, it was observed that prefabricated concrete spacers have a certain water absorption capacity, as a result of which, in the interfacial region, water is drawn out of the poured-in concrete as it cures; this leads to impairment of the curing concrete material during the formation of hydrates, so that after curing, concrete phases of different chemical compositions are still present alongside each other, resulting in different mechanical and chemical properties in the interfacial region which gradually lead to the formation of capillary or hairline cracks in the interfacial region.

The aforesaid document DE-U-87 04 698 has disclosed a process for manufacturing the body of a spacer from polymer concrete. "Polymer concrete" is understood to be a concrete material in which, to improve utilization characteristics, the hydraulic binder is entirely or partly replaced by substances based on synthetic resins. Polymer concrete is thus a mixture consisting of a synthetic resin such as epoxy resin, polyurethane resin, or polyester resin, which is mixed with fillers in the form of grains, especially with mineral fillers such as quartz sand, quartz powder, dolomite, or other rock powders. The synthetic resin has suitable catalysts and accelerators added to it, so that if this compound is poured into molds, correspondingly shaped spacers are produced after the material cures. Depending on the manner of use, retaining elements, usually in the form of bent wire elements, can be incorporated into the curing plastic compound; by means of these the spacers can be clipped or slid onto reinforcing bars of the reinforcements. If the spacer is acting as the end cap for a reinforcing rod, i.e. if it is providing the appropriate spacing between one end of a reinforcing bar and a corresponding outer wall, the spacer usually has a blind hole into which the reinforcing bar can be inserted. In this case no further retaining elements are then needed.

The mixing ratios between aggregates and synthetic resin are selected so that the resulting body of the spacer has very high compressive and breaking strength, and also has a coefficient of thermal expansion that is as close as possible to that of the concrete. To ensure that the aggregates are uniformly distributed in the body, the consistency of the plastic compound is selected so that the during curing, the granular aggregates do not sink under their own weight, but rather float in the curing synthetic resin compound. The resulting spacers then consequently have a sealed, smooth surface consisting of cured plastic material.

It has now been observed in long-term testing that over time, a capillary crack, through which moisture can penetrate from the exterior, gradually forms between the sealed surface of the spacer made of cured plastic material and the cured concrete surrounding it.

For example, it has been found that in concrete walls provided with polymer concrete spacers of this kind, after a period corresponding to 15 years, moisture can penetrate from the exterior up to 20 mm into the boundary region between the exterior of the spacer and the concrete. Since the required covering corresponds approximately to this dimension, it is possible, after this period of time at the latest, for moisture to come into direct contact with the metal reinforcement, meaning that corrosion can occur. Since, however, buildings are normally erected for a considerably longer service life, negative effects must be expected no later than this point in time.

The object of the present invention is therefore to overcome these drawbacks and improve a process of the aforesaid type and a spacer of the aforesaid type in such a way that penetration of moisture between the surface of the body of the spacer and the concrete surrounding it is prevented over a long period of time.

In accordance with the invention, the object is achieved in a process by the fact that subsequently, a quantity of plastic material is removed from the surface of the cured body such that grains project from the cured plastic material.

In accordance with the invention, the object is achieved in a spacer by the fact that the surface of the body is post-treated in such a way that grains of the aggregates project from the surface of the cured plastic material.

Exposure of the grains incorporated into the plastic material, which usually consist of quartz-containing sand, makes possible a chemical attachment to the cement paste of the poured concrete. That means that these exposed grains projecting out from the plastic matrix are chemically integrated, during curing, into the calcium silicate and calcium aluminate matrix of the poured and curing concrete, thus forming intimate attachment points between the body of the spacer on the one hand, and the calcium silicate/calcium aluminate matrix of the curing concrete, on the other hand. At the same time, an intimate mechanical interlocking occurs between the body of the polymer concrete spacer and the curing concrete. This particularly intimate chemical and physical bond in the transition region between the exterior of the spacer body and the curing concrete surrounding it ensures a durably tight attachment in this interfacial region, into which no moisture can penetrate even after decades have passed. Because of this intimate chemical and physical attachment between the surface of the spacer and the cured concrete surrounding it, external mechanical loads can be handled considerably better, and can be better distributed because of the larger surface area in the interfacial region between the spacer and the concrete. As a result, stresses that occur with thermal expansion due to differences in temperature coefficients can be better dissipated without the formation of a capillary or hairline crack between these materials in the boundary region. Even if microscopic cracks should form—and they can form only in the transition region between the cured cement paste and regions of cured plastic matrix that are in direct contact—because of the numerous direct chemical attachment points at the projecting grains, the entire interfacial transition region presents such a high flow resistance to moisture penetrating from the exterior that even capillary action is insufficient to allow moisture to penetrate to any appreciable extent. The intimate chemical and physical bond can be regarded as a kind of "labyrinth seal" that prevents the penetration of moisture.

It has been found in tests that under conditions which correspond to a 15-year lifetime for a concrete (cyclical temperature change day/night and summer/winter, cyclical mechanical loads), the moisture penetration depth is limited to a few millimeters. This penetration is due to a certain porosity in the cured concrete material, and is also promoted by curing and aging processes in the concrete and the plastic material. Further penetration was not, however, observed.

The object is thus completely achieved.

In a further embodiment of the invention, material is removed from the surface of the spacer by a process such that craters due to detached grains are created between the projecting grains.

The advantage of this feature is that the cement paste of the concrete can penetrate into these craters when the spacer is embedded, creating a particularly intimate bond.

In a further embodiment of the invention, removal of the plastic material from the surface is implemented by a mechanical procedure.

The advantage of this feature is that the process is especially easy and economical to perform. The quantities of material removed by the mechanical procedure, namely cured plastic material and detached grains, can then be reused as aggregate in the manufacture of other spacer bodies, in other words can be more or less "recycled."

In a further embodiment of the invention, removal is implemented by sandblasting the exterior of the body of the spacer.

The advantage of this feature is that removal can be implemented with physically simple and economical means.

In a further embodiment of the invention, removal of plastic material from the surface of the body of the spacer is implemented by chemical dissolution of cured plastic material, especially by etching the exterior.

The advantage of this feature is that this procedure is very easy to implement, for example by immersing or spraying the body with a solvent that dissolves the cured plastic material.

In a further embodiment of the invention, etching is performed so as to dissolve a quantity of plastic material such that many grains are detached.

The advantage of this feature is that, as previously mentioned in conjunction with mechanical treatment, the craters of the grains that have fallen out or become detached create additional points that allow a particularly intimate bond with the concrete.

It is self-evident that the features mentioned above and those yet to be explained below can be used not only in the particular combination indicated, but also in other combinations or in isolation, without leaving the context of the present invention.

Several exemplary embodiments in accordance with the invention will be described and explained in more detail with reference to the enclosed drawings.

Figure 3A:
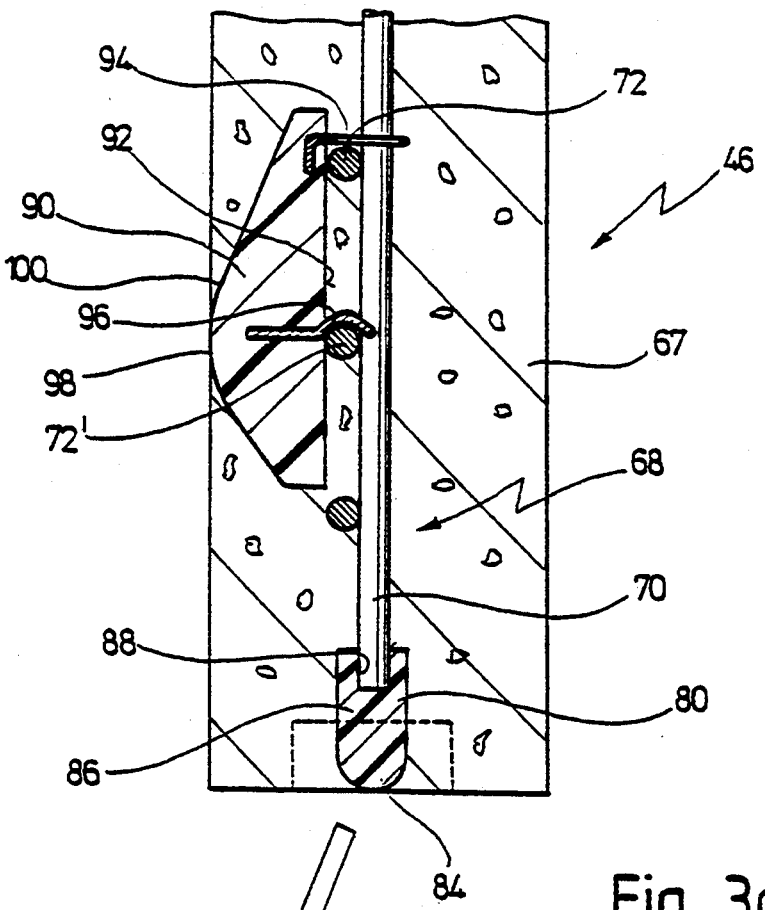
Figure 3B:
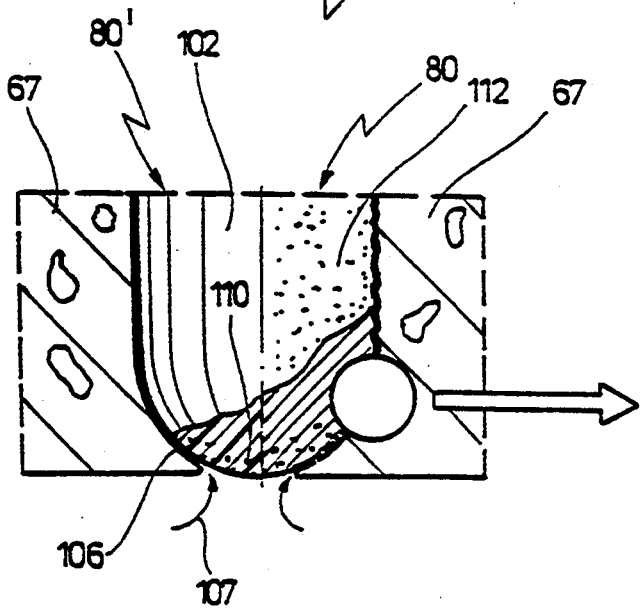

FIG. 3*a* shows a section through a concrete wall in which is incorporated a reinforcement that is provided with further exemplary embodiments of spacers in accordance with the invention;

FIG. 3*b* shows a selective depiction of the region enclosed in dashed lines in FIG. 3*a;*

Figure 3C:
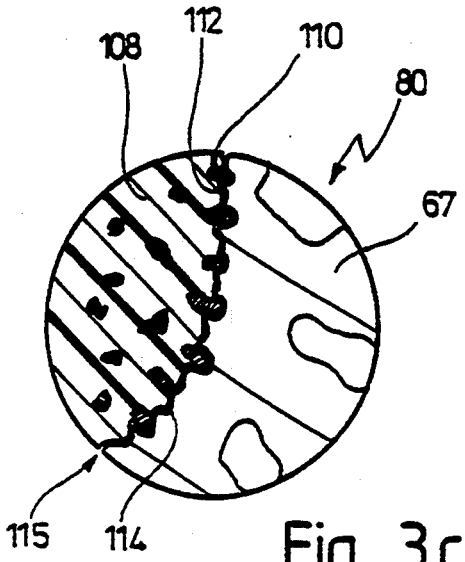
Figure 5:
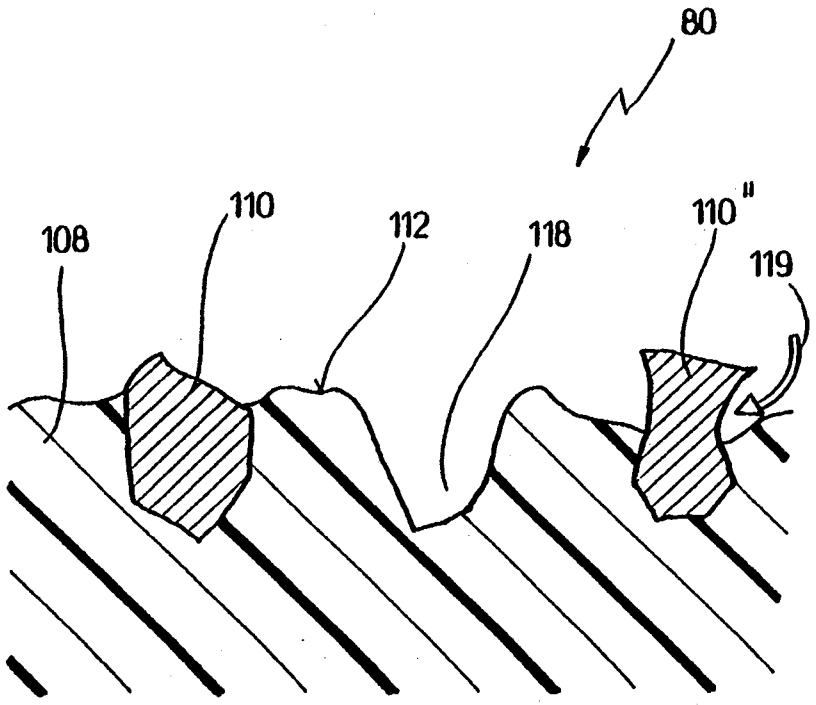
Figure 4:
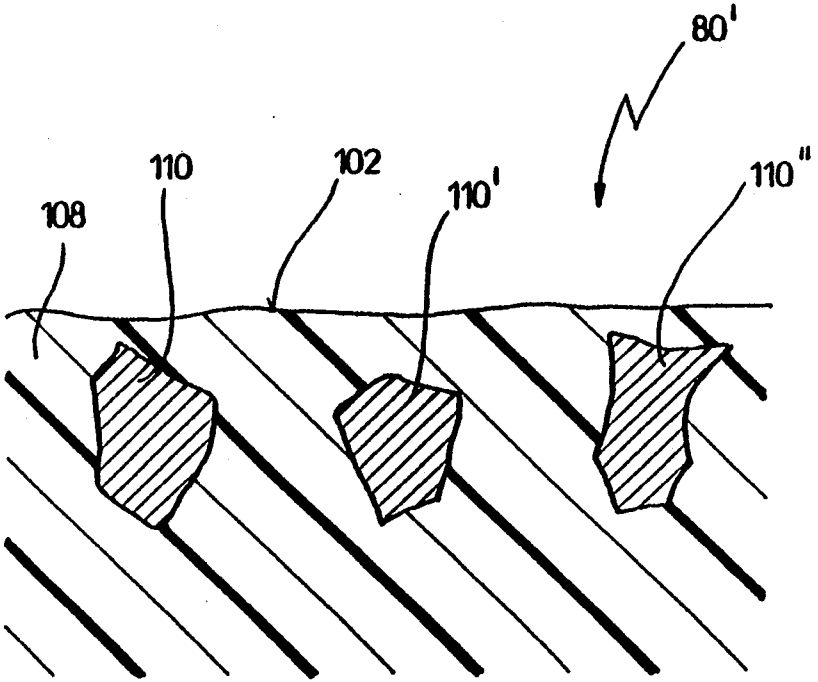

FIG. 3*c* shows a more greatly enlarged selective view of region marked in FIG. 3*b* with a circle;

FIG. 4 shows an even more extremely enlarged selective sectioned depiction of a spacer in accordance with the invention, in a stage of its manufacturing process prior to treatment of the surface; and FIG. 5 shows a depiction corresponding to FIG. 4, after treatment of the surface.

Figure 1:
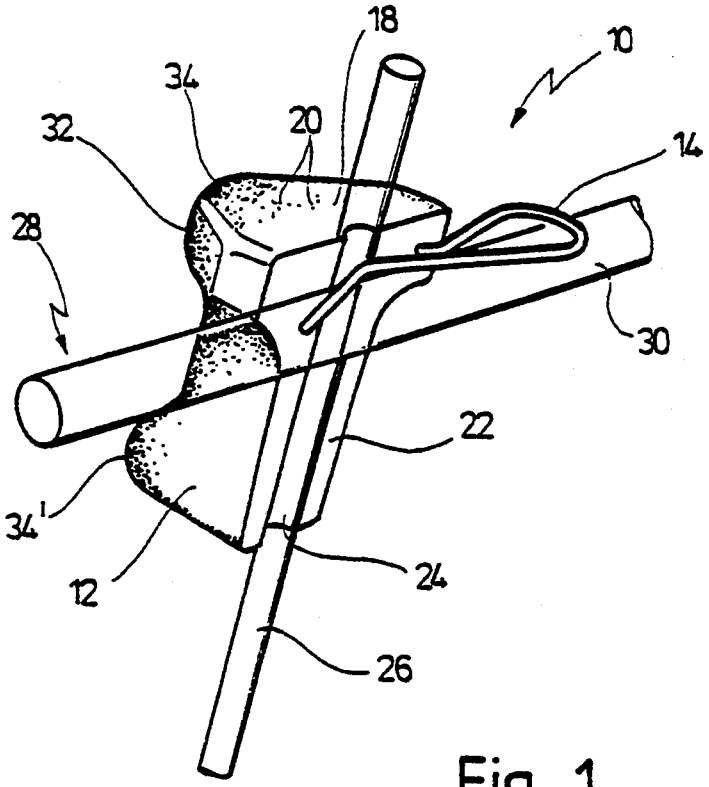
FIG. 1 shows a perspective view of a first exemplary embodiment of a spacer in accordance with the invention.

FIG. 1 depicts a first exemplary embodiment in accordance with the invention of a spacer 10.

The spacer 10 has a body 12, spaced away from which is a retaining element 14.

The retaining element 14 consists of a bent spring steel wire.

The body 12 is constructed of polymer concrete 16.

The polymer concrete 16 consists of a cured plastic material 18 which contains grains 20 in the form of quartz powder.

The plastic material 18 was produced by curing a synthetic resin (epoxy or polyester), such as one marketed, for example, under the name "ALPOLIT UP 303." It also contains, at a proportion of twice the weight (in other exemplary embodiments at up to five times the weight) of the synthetic resin, a filler in the form of a quartz powder with a grain size distribution in the range from 20 μm to 1 mm; the grains can be rounded and/or have fracture surfaces. It also contains hardeners and accelerators. As is generally known in this art, the starting substances are mixed together and poured into a mold that corresponds to the negative shape of the body 12. The retaining element 14 is set into the curing compound.

The result after curing is initially a body 12 with a smooth, sealed surface, that is subsequently treated, by removal of cured plastic material 18, in a manner described in more detail below in conjunction with FIGS. 4 and 5, resulting in the exposure of grains.

The resulting body 12 as depicted in FIG. 1 has a surface from which grains 20 project.

A rear surface 22 of the body 12 is provided with a groove 24 that is used for application onto a reinforcing bar 26 of a reinforcement 28. In this context, the retaining element 14 is shaped so that a reinforcing bar 26 laid in the groove 24 is retained by the retaining element 14. The retaining element 14 rests on a transverse reinforcing bar 20 so that a spacer 10 clipped onto the reinforcing bar 26 cannot slide down (as depicted in FIG. 1) along the reinforcing bar 30.

The spacer 10 is in contact, at an edge facing the form 32, with an inner surface of a form (not depicted here in more detail), and provides the corresponding correct spacing between the inner surface of the form and the reinforcement 28. In this exemplary embodiment depicted in FIG. 1, the edge 32 facing the form consists of two projections 34, 34'.

Figure 2:
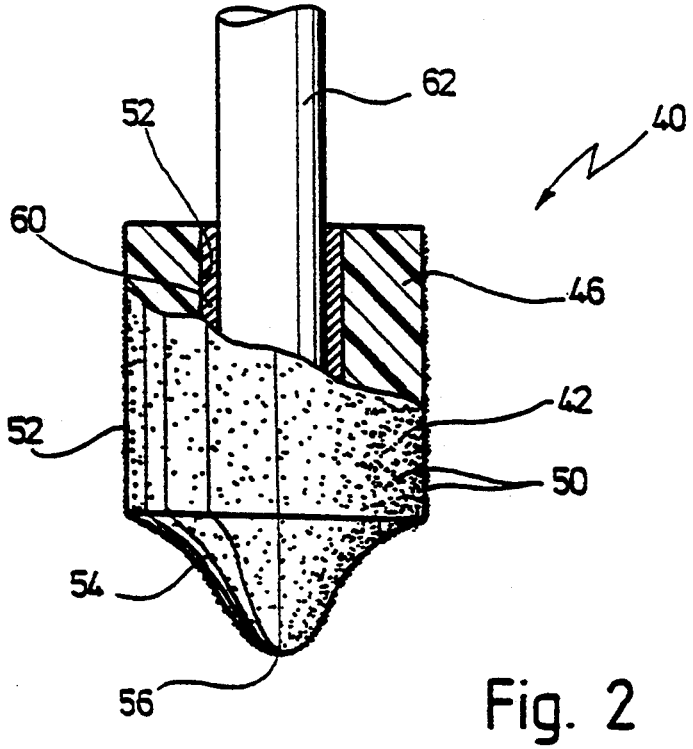
FIG. 2 shows a partially sectioned side view of a further exemplary embodiment of a spacer in accordance with the invention.

FIG. 2 depicts a further spacer 40 in accordance with the invention, the body 42 of which is also made of polymer concrete 46 which has the same composition as described earlier in conjunction with FIG. 1.

That means that here again, grains 50 are integrated into a cured plastic material 48.

The body 42 has a cylindrical section 52 that merges at a lower end (as depicted in FIG. 2) into a conical support foot 54.

A conical tip 56 of the conical support foot 54 represents the contact point of the spacer 40 that faces the form.

Provided in the cylindrical section 52 on the side opposite the conical support foot 54 is a blind hole 58, open at the top, into which a plastic sleeve 60, open at the top, is inserted.

The plastic sleeve 60 and the blind hole 58 serve to receive one end of a reinforcing bar 62.

The spacer 40 thus provides the correct spacing or the correct covering between a lower end of a reinforcing bar 62 located vertically in, for example, a wall of a concrete tube.

The spacer 40 is also manufactured by initially casting the body 42 in a corresponding mold, and subsequently treating its exterior with a sandblasting procedure so that grains 50 are exposed.

FIG. 3*a* depicts a practical application of spacers, specifically a concrete wall 66 enclosing a reinforcement 68 that is surrounded by concrete 67. A vertical reinforcing bar 70 and a plurality of horizontal reinforcing bars 72, 72', etc. (in section) of the reinforcement 68 are evident in the sectioned depiction of FIG. 3*a*.

Evident at the lower end of the reinforcing bar 70 is a spacer 80, the body 82 of which is essentially constructed like the spacer 40 described in conjunction with FIG. 2, although its lower end, in contrast thereto, is designed as a half sphere 84.

The spacer 80 is also made of polymer concrete 86, and has a corresponding blind hole 88 to receive the reinforcing bar 70.

Evident in FIG. 3*a* is a further spacer 90, which is similar in function and configuration to the spacer 10 described in FIG. 1.

The spacer 90 has on its rear surface 92 two projecting retaining elements 94 and 95.

The edge 98 facing the form, located opposite to the rear surface 92, is designed as an inclined ramp 100. The spacer 90 is clipped onto the reinforcing bar 70 by means of the retaining element 94, and clipped onto the reinforcing bar 72' by means of the retaining element 96.

FIG. 3*b* depicts a region enclosed in a dashed line at the bottom of FIG. 3*a*, at enlarged scale. Excerpted from FIG. 3*b* is a circular region that is depicted in FIG. 3*c* at even more greatly enlarged scale.

Depicted in the left half of FIG. 3*b*, namely to the left of the vertical dot-dash line, is the body of the spacer 80', depicted as it is produced according to the aforesaid process in a mold, i.e. with a sealed smooth surface 102. The quartz grains 110 are not evident from the exterior, even those that are located directly below the surface 102. The smooth-surfaced spacer 80' integrated into the concrete wall 66 carries the risk that between its entire smooth surface 102 and the concrete 67 surrounding it, there will form over time a capillary crack 106, through which moisture, depicted by an arrow 107, can penetrate from the exterior between the surface 102 and the corresponding opposite concrete surface. Liquid can penetrate, through the gradually expanding capillary crack 106, to the top end of the spacer 80', and then come into contact with the reinforcing bar 70 (see FIG. 3*a*) and cause corrosion there.

The right side of FIG. 3*b* depicts the spacer 80, i.e. with a surface 112 treated in accordance with the invention, in which the grains 110 project from the cured plastic material 108.

As is evident especially from FIG. 3*c*, a particularly intimate bond forms with the concrete 67. Even if a capillary crack should form in the transition region between the surface 112 of the spacer 80 and the concrete 67, this crack, as is strikingly evident from FIG. 3*c*, constitutes a labyrinth 114 that presents a substantial flow resistance to penetrating moisture, as indicated by an arrow 115.

FIG. 4 depicts a section of the spacer 80' at even more greatly enlarged scale, showing its smooth surface 102.

Embedded in the cured plastic material 108 are quartz grains 110, 110', 110'', which nonetheless do not penetrate to the exterior. In the manufacture of the spacer 80', the consistency of the synthetic resin is selected so that the grains float in it, or in any event sink under their own weight in a controlled manner, so that a smooth, sealed surface 102 consisting of cured plastic material 108 has thus been produced on the exterior of the spacer 80'.

In accordance with the invention, the smooth surface 102 is then subjected to a treatment; in the exemplary embodiment depicted, it is exposed to a mechanical treatment, specifically a sandblasting treatment.

The result is the rough surface 112 visible in FIG. 5.

The rough surface 112 is created on the one hand by the fact that the sandblasting has removed plastic material 108. This occurs, because of the brittleness of the plastic material 108, in the form of small fragments. The resulting surface of the spacer 80 is correspondingly uneven or rough, and allows an intimate attachment to the cement paste of the concrete in which the spacer 80 is to be embedded. As is visible in FIG. 5, care is taken in the sandblasting treatment to ensure that the amount of plastic material 108 removed is such that portions of the grains 110, 110' project above the surface 112. "Naked" regions of the grains 110, 110', no longer covered with plastic material 108, thus protrude.

Also evident from FIG. 5 is the fact that in the sandblasting treatment, a quantity of plastic material 108 was removed from above the grain 110' such that the grain 110 has completely detached. This produces a detachment rough spot in the form of a crater 118, and contributes to additional roughness of the surface 112.

The grain 110'' projecting from the plastic material 108 is a fractured grain whose protruding portion flares outward like a trumpet. When the spacer 80 is embedded in concrete, the cement paste of the fluid concrete can penetrate into the undercut region, as indicated by an arrow 119. After curing, this produces an intimate interlock between the spacer and the cured concrete.

The roughness of the surface 112 is thus composed of rough surface regions of the plastic material 108, and projecting "naked" regions of the grains 110, 110''. The roughness of the surface region of the plastic material 108 is composed of detachment points where plastic material has been removed, and craters 118 that contained detached grains 110'. The projecting naked regions of the grains make possible a chemical attachment to the curing cement paste of the concrete; in other words these quartz grains are chemically bonded into the silicate matrix. As a result, innumerable chemical bonding points with the cured cement paste, standing up like bristles from the surface of the spacer 80, are created, ensuring that because of these attachment points, no further interfacial transition regions (in the strict sense) exist between two heterogeneous objects, so that the risk that capillary or hairline cracks will form in these regions is thereby completely eliminated.

The intimate interlocking in the regions of the plastic material surface between the grains, created by the detachment points and the craters 118, also produces an intimate mechanical bond in this region; the overall result is that a spacer in accordance with the invention is embedded in the concrete so as to constitute a permanent intimate bond that excludes penetration of moisture.

The transition from the smooth surface 102 as depicted in FIG. 4 to the roughened surface 112 as depicted in FIG. 5 was previously described in conjunction with a sandblasting procedure.

It is also possible to achieve this roughening in mills with large-grained grinding material, or to achieve it chemically. In the latter case, the surface 102 is sprayed with a solvent that dissolves the cured plastic material 108. Dissolution continues until several grains 110, 110'' are again exposed. It is not impossible that a tenuous film may then still remain on the surface of the projecting grains, but this extremely thin coating will be immediately removed mechanically when brought into contact with the curing concrete.

What is claimed is:

1. A spacer for positioning reinforcements, said spacer comprising:

a body made of polymer concrete consisting of a cured plastic material having aggregates in the form of grains integrated in and dispersed throughout said plastic material, said body being adapted to be embedded in cementitious material for positioning said reinforcements within and in spaced relation to the exterior surface of said cementitious material, a predetermined surface of said body being characterized by a portion of cured plastic material having been detached from the exterior of said body whereby portions of random ones of said grains are exposed and project from said cured plastic material and whereby random craters are formed in said surface to interlock with said cementitious material and to form a moisture sealed bond.

2. The spacer of claim 1, wherein said grains are fractured quartz grains and said portions of said grains form undercut regions to receive said cementitious material and form an intimate interlock therewith.

3. The spacer of claim 1, wherein said aggregates and said plastic material have densities such that the aggregates sink into said polymer concrete during curing whereby to form a spacer body having a generally smooth exterior.

4. The spacer of claim 3, wherein the predetermined surface of said body is characterized by a portion of the generally smooth exterior of said cured plastic material having been detached by sand blasting, at least in part and in place, whereby to expose said portions of said grains.

5. The spacer of claim 3, wherein said predetermined surface of said body being characterized by a portion of the generally smooth exterior of said cured plastic material having been detached by chemical dissolution, at least in part and in place, whereby to expose said portions of said grains.

6. The spacer of claim 1, wherein a retaining element for engaging and positioning a reinforcement is secured to said body, said retaining element having a first portion embedded in said cured plastic material and a second portion projecting outwardly from the predetermined surface of said body, and said body, including said retaining element, is adapted to be embedded within the cementitious material, the second end portion of said retaining element extending to a location remote to the exterior of said cured plastic material for engaging and positioning a reinforcement interiorly of said cementitious material, the interlocking engagement between said predetermined surface and the cementitious material inhibiting moisture from the exterior of said cementitious material from reaching said reinforcement.

7. A spacer for positioning a reinforcement relative to a mold form into which liquid concrete will be poured and allowed to harden about said spacer and said reinforcement, said spacer comprising:

a body comprised of a plurality of quartz grains interbonded and cured in place in a polymer concrete and having an exposed surface, said exposed surface resulting from a predetermined amount of the cured polymer concrete having been removed from said body in an amount such that exposed portions of said grains project from said exposed surface and such that randomly positioned craters are formed in said surface to form areas of chemical and mechanical attachment for the poured concrete.

8. A spacer for a reinforcement and adapted to be embedded into a mass of cementitious material, said spacer comprising a body made of polymer concrete consisting of a cured plastic material having aggregates in the form of grains dispersed generally uniformly throughout said material, a predetermined surface of said body being characterized by a portion of said cured plastic material having been removed in place from said body to expose at least some of said grains and form craters to interlock with said cementitious material and to form a moisture sealed bond therewith, said exposed grains projecting in part from said predetermined surface of said cured plastic material and said craters extending into said predetermined surface.

9. A spacer for positioning a reinforcement relative to a mold form into which liquid concrete will be poured and allowed to harden about the spacer and the reinforcement, said spacer comprising a body comprised of a plurality of quartz grains interbonded and cured in place in a polymer concrete and having a generally smooth exterior surface, said grains being relatively uniformly dispersed in said polymer concrete and disposed below the exterior surface of said body, and a portion of said exterior surface having been post-treated by removal of a predetermined amount of said cured polymer concrete in such a way as to form a nonsmooth surface and to expose portions of at least some of said grains, said exposed portions of said grains projecting from said nonsmooth surface to form areas of chemical attachment to the poured liquid concrete.

10. A spacer for ensuring accurate positioning of a reinforcement within a form into which liquid concrete will be poured and allowed to harden whereby the reinforcement will be at a predetermined distance for the exterior surface of the concrete element produced in said form, said spacer comprising a body made of polymer concrete consisting of a cured plastic material having aggregates in the form of grains integrated in and dispersed throughout said plastic material, said resulting body having a generally smooth surface consisting of cured plastic material and said grains comprising fractured quartz, a predetermined surface of said body being post-treated by removal of cured plastic material from said smooth surface in such a way that exposed portions of random ones of said grains project from the predetermined surface of said cured plastic material, said exposed projecting grains allowing a chemical attachment with the liquid concrete.

* * * * *